US011618125B2

(12) United States Patent
Schumacher et al.

(10) Patent No.: US 11,618,125 B2
(45) Date of Patent: Apr. 4, 2023

(54) METHOD OF CONNECTING A FERRULE TO AN OPTICAL FIBER POLISHING FIXTURE ASSEMBLY

(71) Applicant: Domaille Engineering, LLC, Rochester, MN (US)

(72) Inventors: Gregory A. Schumacher, Plainview, MN (US); Jill B. Christie, Saint Charles, MN (US); Erin L. Schleusner, Fountain, MN (US); Dennis J. Anderson, Zumbro Falls, MN (US)

(73) Assignee: Domaille Engineering, LLC, Rochester, MN (US)

( * ) Notice: Subject to any disclaimer, the term of this patent is extended or adjusted under 35 U.S.C. 154(b) by 0 days.

(21) Appl. No.: 17/722,552

(22) Filed: Apr. 18, 2022

(65) Prior Publication Data

US 2022/0234168 A1 Jul. 28, 2022

Related U.S. Application Data

(62) Division of application No. 16/526,582, filed on Jul. 30, 2019, now Pat. No. 11,458,588.

(51) Int. Cl.
*B24B 41/06* (2012.01)
*B24B 19/22* (2006.01)

(52) U.S. Cl.
CPC ..... *B24B 41/067* (2013.01); *B24B 19/226* (2013.01)

(58) Field of Classification Search
CPC ..... B24B 19/226; B24B 41/067; B24B 41/06; B24B 13/005; B24B 37/30; F16B 2/18; G02B 6/3616; G02B 6/3624; G02B 6/3628; G02B 6/3644; G02B 6/3608; G02B 6/38; G02B 6/25
See application file for complete search history.

(56) References Cited

U.S. PATENT DOCUMENTS

| | | | |
|---|---|---|---|
| 4,693,035 | A | 9/1987 | Doyle |
| 4,819,386 | A | 4/1989 | Struyf |
| 5,018,316 | A | 5/1991 | Mulholland et al. |
| 5,185,966 | A | 2/1993 | Mock, Jr. et al. |
| 5,201,148 | A | 4/1993 | Rupert et al. |
| 5,216,846 | A | 6/1993 | Takahashi |
| 5,321,917 | A | 6/1994 | Franklin et al. |

(Continued)

OTHER PUBLICATIONS

Domaille Engineering Product Brochure, OFConference PDF (Year: 2020).*

(Continued)

*Primary Examiner* — Joel D Crandall
*Assistant Examiner* — Makena S Markman
(74) *Attorney, Agent, or Firm* — Dicke, Billig & Czaja, PLLC

(57) ABSTRACT

A method of connecting a ferrule to an optical fiber polishing fixture assembly comprises obtaining a fixture base to which a clamping assembly is operatively connected, positioning a lever in an unlocked position thereby creating a gap between first and second base portions, obtaining a fiber optic connector and cable assembly including a ferrule operatively connected to a cable, positioning the ferrule in a ferrule bore, and moving the lever from the unlocked position to a locked position thereby causing the first and second base portions to engage the fiber optic connector and cable assembly.

2 Claims, 17 Drawing Sheets

(56) References Cited

U.S. PATENT DOCUMENTS

| | | | | |
|---|---|---|---|---|
| 5,412,747 | A | 5/1995 | Matsuoka et al. | |
| 5,547,418 | A | 8/1996 | Takahashi | |
| 5,640,475 | A | 6/1997 | Takahashi | |
| 5,643,064 | A | 7/1997 | Grinderslev et al. | |
| 5,674,114 | A | 10/1997 | Miller et al. | |
| 5,702,293 | A | 12/1997 | Barth et al. | |
| 5,711,701 | A | 1/1998 | Grinderslev et al. | |
| 5,720,653 | A | 2/1998 | Miller et al. | |
| 5,769,698 | A | 6/1998 | Chudoba et al. | |
| 5,863,242 | A | 1/1999 | Waldron et al. | |
| 6,039,630 | A | 3/2000 | Chandler et al. | |
| 6,396,996 | B1 | 5/2002 | Carpenter et al. | |
| D474,212 | S | 5/2003 | Domaille et al. | |
| 6,718,111 | B1 | 4/2004 | Suek et al. | |
| 6,808,444 | B1 | 10/2004 | Kuprin et al. | |
| 6,979,255 | B2 | 12/2005 | Yamada et al. | |
| 7,494,402 | B2 | 2/2009 | Yamada et al. | |
| 7,738,760 | B2 | 6/2010 | Fredrickson et al. | |
| D650,817 | S | 12/2011 | Schumacher | |
| 8,708,776 | B1 | 4/2014 | Frazer | |
| 9,759,872 | B1 * | 9/2017 | Schumacher | B24B 19/226 |
| 2004/0161219 | A1 | 8/2004 | Suek et al. | |
| 2008/0119111 | A1 * | 5/2008 | Zhang | B24B 19/226 451/384 |

OTHER PUBLICATIONS

Connector, 8 pages; date: known of prior to filing; Domaille Engineering, Rochester, MN.
Connector, 2 pages; date: known of prior to filing; Domaille Engineering, Rochester, MN.
AbraSave® MT-EZ Fixture Line, 2 pages; date: known of prior to filing; Domaille Engineering, Rochester, MN.
MTP/MPO Connector, 1 page; date: known of prior to filing; Domaille Engineering, Rochester, MN.
MTRJ Connector, 1 page; date: known of prior to filing; Domaille Engineering, Rochester, MN.
AbraSave™ High Volume Fixtures, 2 pages; date: known of prior to filing; Domaille Engineering, Rochester, MN.
AbraSave® Ferrule Only Connector, 1 page; date: known of prior to filing; Domaille Engineering, Rochester, MN.
Ferrule Only Connector, 1 page date: known of prior to filing; Domaille Engineering, Rochester, MN.
Ferrule Only Connector E2000, 1 page; date: known of prior to filing; Domaille Engineering, Rochester, MN.
Connector-DCW-840-12, S/N 9872, 1 page; date: known of prior to filing; Domaille Engineering, Rochester, MN.
Connector SFA-DCD25635124-6, S/N 9430, 1 page date: known of prior to filing; Domaille Engineering, Rochester, MN.
"About Our Polishing Fixtures," http://wwwdomailleengineering.com/optical-fiber-polishing/polishing-fixtures.php, 1 page; May 17, 2016.
"AbraSave® Advantages," http://www.domailleengineering.com/abrasave/abrasave-advantages.php, 1 page; May 17, 2016.
"AbraSave® Fixtures," http://www.domailleengineering.com/optical-fiber-polishing/polishing-fixtures/abrasave-fixtures.php, 1 page; May 17, 2016.
Domaille Engineering, "Technology for Tomorrow," Fixture Product Book, 8 pages. 2014.
OFS Fitel, SC Product Specification, Issue 1, Mar. 2002, 50 pages.
Senko Group® Polishing Accessories, http://www.senko.com/fiberoptic/download_pdf.php?product=120 (2015) (1 Page).
Senko Group® MT Polishing Fixture, http://www.senko.com/literature/24-Position-MPO-%20Fixture-Handout.pdf (2015) (2 Pages).

* cited by examiner

METHOD OF CONNECTING A FERRULE TO AN OPTICAL FIBER POLISHING FIXTURE ASSEMBLY

CROSS-REFERENCE TO RELATED APPLICATIONS

This application is a divisional application of U.S. patent application Ser. No. 16/526,582, filed Jul. 30, 2019, now U.S. Pat. No. 11,458,588, issued Oct. 4, 2022, entitled OPTICAL FIBER POLISHING FIXTURE, which is incorporated by reference in its entirety herein.

BACKGROUND

A commonly used SC fiber optic connector, used for Telecom and Datacom applications, has a two-piece push-pull connector housing design. The inner housing is typically white and houses a ceramic ferrule and a metal flange assembly. There are two horizontal bars on the side of the inner housing that make the mechanical reference plane. The adapter to which the connector mates includes latches that catch the bars to hold the connector securely. The outer housing or "grip" slides over the inner housing and the installer grasps the outer housing to push it into the adapter or pull it to release it from the adapter. There are four ramps on the outer housing that when pulled will release the adapter latches from the bars of the inner housing allowing the connector to be removed. There are typically three different colors of outer housings: Blue represents single mode, Beige represents multimode, and Green represents angled endface single mode.

SC fiber optic cable fibers can be polished to produce a particular performance specification. Optical fiber polishers typically include a rotating platen and an arm mechanism that positions and supports the connectors during the polishing process. Typically, the end face is lowered onto a film resting on the platen, and depending upon the film, the speed of the platen, the pressure applied, and its duration, produces a product suitable for a particular application.

Optical fiber polishers generally include a fixture coupled to the arm mechanism that is capable of holding and gripping one or more fiber optic connectors and advancing them under controlled conditions of speed and force to engage a plurality of fiber optic ends into engagement with a polishing member such as a rotatable platen having an abrasive surface. In order to achieve the precision typically needed, the fiber optic connectors must be secured within the fixture in such a way that all the connectors protrude from the bottom of the fixture at approximately the same angle and to approximately the same extent.

Current SC polishing fixtures utilize a molded plastic clip that has two latches that hold onto the bars of the inner housing and are released by the outer housing when pulled, similar to the adapter to which the SC connector mates.

Certain applications use the SC connector without the outer housing. This leaves a gap between the clip and the inner housing where the outer housing typically is, allowing the connector to rotate when inserted in the polishing fixture. Also, without the outer housing there is no way to release the latches of the clip to remove the SC connector. The cable typically used for this application is flat and reinforced with 2 fiberglass rods that makes the cable very stiff and only able to bend in one direction. The standard fixture clips are not strong enough and not designed to hold the SC without the outer housing.

As such, fixtures typically employ complex clamping assemblies that are used to hold the connectors at the desired angle and depth. These clamping assemblies can require extensive manipulation from an operator in order to load and unload the connectors from the fixture, thus increasing the time needed to polish multiple connectors. In addition, existing fixtures can present obstacles when one or more of the clamping assemblies needs replacing. For example, when even a single clamping assembly needs replacing, an operator may need to halt polishing in order to send the entire fixture back to the manufacturer for repairs.

For the reasons stated above and for other reasons stated below, which will become apparent to those skilled in the art upon reading and understanding the present specification, there is a need in the art for an improved optical fiber polishing fixture, including a spring member and a clamping assembly.

BRIEF SUMMARY

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In one embodiment, an optical fiber polishing fixture assembly comprises a fixture base and a clamping assembly. The fixture base has a receiving cavity in which a ferrule support having a ferrule bore is positioned. The clamping assembly has first and second base portions, a lever, and a biasing member. The first base portion has a first inner facing side with a first slot and a first inner facing surface. The second base portion has a second inner facing side with a second slot and a second inner facing surface. The first and second slots are configured and arranged to receive bars on opposing sides of a fiber optic connector and cable assembly. The lever has a first end positioned between the first and second inner facing surfaces and a second end extending outward therefrom. The biasing member biases the first and second base portions toward each other. The first and second base portions, the first end of the lever, and the biasing member are configured and arranged to be received in the receiving cavity and operatively connected to the fixture base. The clamping assembly has a locked position and an unlocked position. The locked position is when the first and second base portions are biased toward one another, and the unlocked position is when the lever overcomes a biasing force of the biasing member and separates the first and second base portions. When the lever is moved from the locked position to the unlocked position, the lever overcomes the biasing force and moves the first and second base portions away from one another.

In one embodiment, a method of connecting a ferrule to an optical fiber polishing fixture assembly comprises obtaining a fixture base to which a clamping assembly is operatively connected, positioning a lever in an unlocked position thereby creating a gap between first and second base portions, obtaining a fiber optic connector and cable assembly including a ferrule operatively connected to a cable, positioning the ferrule in a ferrule bore, and moving the lever from the unlocked position to a locked position thereby causing the first and second base portions to engage the fiber optic connector and cable assembly. The fixture base has a receiving cavity in which a ferrule support having a ferrule bore is positioned. The clamping assembly has first and second base portions, a lever, and a biasing member. The first base portion has a first inner facing side with a first inner facing surface. The second base portion has a second inner facing side with a second inner facing surface. The lever has a first end positioned between the first and second inner facing surfaces and a second end extending outward therefrom. The biasing member biases the first and second base portions toward each other. The first and second base portions, the first end of the lever, and the biasing member are configured and arranged to be received in the receiving cavity and operatively connected to the fixture base. The clamping assembly has a locked position, being when the first and second base portions are biased toward one another, and an unlocked position, being when the lever overcomes a biasing force of the biasing member and separates the first and second base portions. As the lever is moved from the locked position to the unlocked position, the lever overcomes the biasing force and moves the first and second base portions away from one another.

BRIEF DESCRIPTION OF THE DRAWINGS

The present invention can be more easily understood, and further advantages and uses thereof can be more readily apparent, when considered in view of the detailed description and the following Figures in which.

In accordance with common practice, the various described features are not drawn to scale but are drawn to emphasize specific features relevant to the present invention. Reference characters denote like elements throughout the Figures and the text.

DETAILED DESCRIPTION

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

Generally, embodiments of the present invention provide a fixture including a spring member and a clamping assembly for securing a cable assembly to a polisher.

Figure 1:
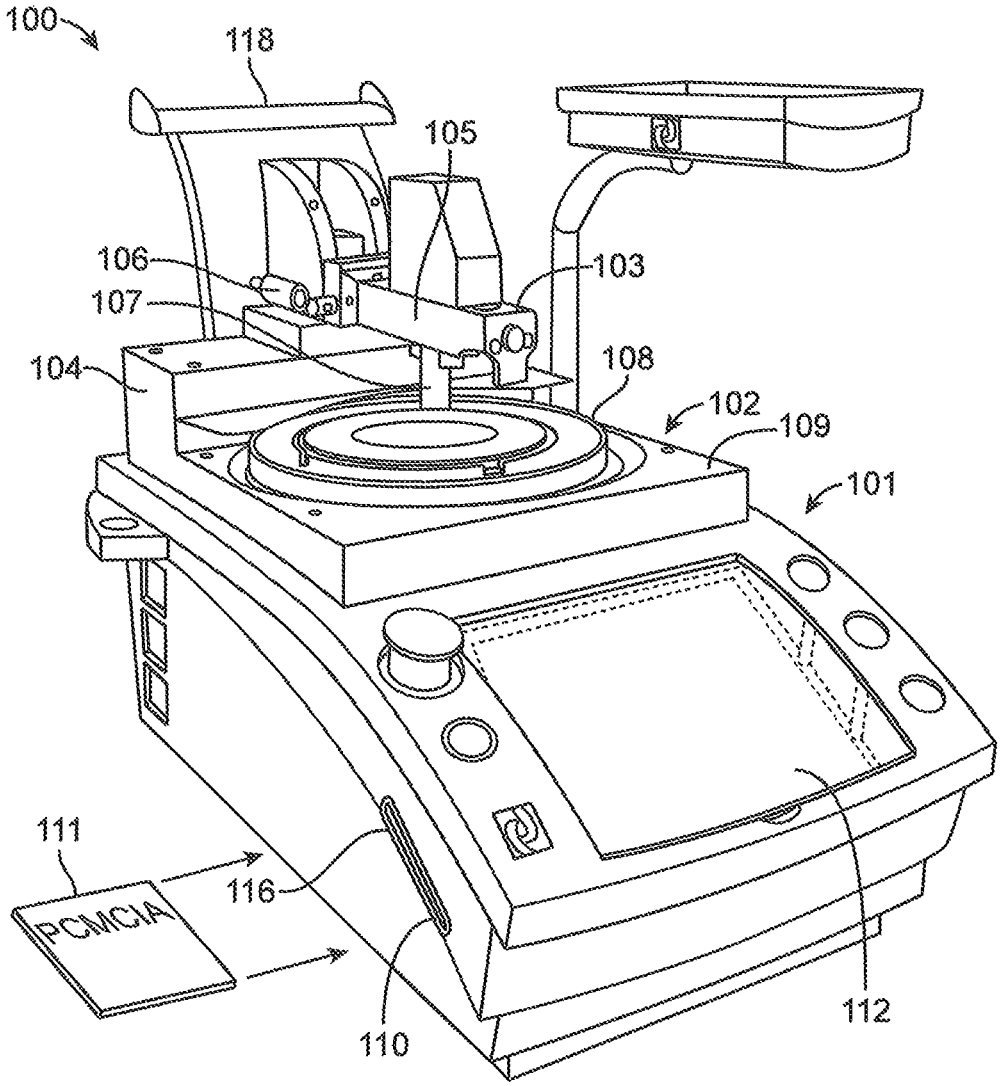
FIG. 1 is a perspective view of an optical fiber polisher constructed in accordance with the principles of the present invention.

FIG. 1 is a perspective view of an optical fiber polisher 100 constructed in accordance with the principles of the present invention. This type of optical fiber polisher 100 is shown and described in U.S. Pat. Nos. 7,738,760 and 8,708,776, which are hereby incorporated by reference, and is Optical Fiber Polishing Machine APM Model HDC-5300 by Domaille Engineering, LLC of Rochester, Minn. Although optical fiber polisher 100 is generally shown and described, it is recognized that other suitable types of polishers could be used with the present invention.

Generally, the polisher 100 includes a polishing unit 102 comprising a pneumatic overarm assembly 103, a platen assembly 108 rotatably supported by a stage 109, a processor, a porting device 110 for a portable memory device 111, and an input device 112. A housing 101 supports and aligns the polishing unit 102, the processor, and the input device 112 in an operative position. A slot 116 is inserted along one side of the housing 101 to allow the portable memory device 111 to access the porting device 110. A cable management attachment 118 is connected to the back of the housing 101 for supporting fiber optic cables undergoing a polishing process.

The pneumatic overarm assembly 103 includes an overarm 105 hingedly secured along one end to a base 104, the overarm 105 rotatable about the hinged end. A pair of pneumatic cylinders 106 is coupled to the overarm 105, opposing rotational movement thereof. A mounting pole 107 extends downward from the overarm 105 and is configured and arranged, as is well known in the art, to connect to a mounting tube 202 of a fixture 200, which is described in more detail below.

The polisher 100 maintains rigid control of each polishing process through feedback mechanisms which control the operation of both the platen assembly 108 and the pneumatic overarm assembly 103. The feedback mechanisms communicate with the processor to continuously monitor the performance of the platen assembly 108 and the pneumatic overarm assembly 103 and ensure that both are functioning at their set levels. In some embodiments, the processor communicates with the porting device 110, the input device 112, and a USB port for a keyboard to enable rapid programming of the polisher 100. The input device 112 also serves as a visual indicator of actual operating parameters.

Figure 2:
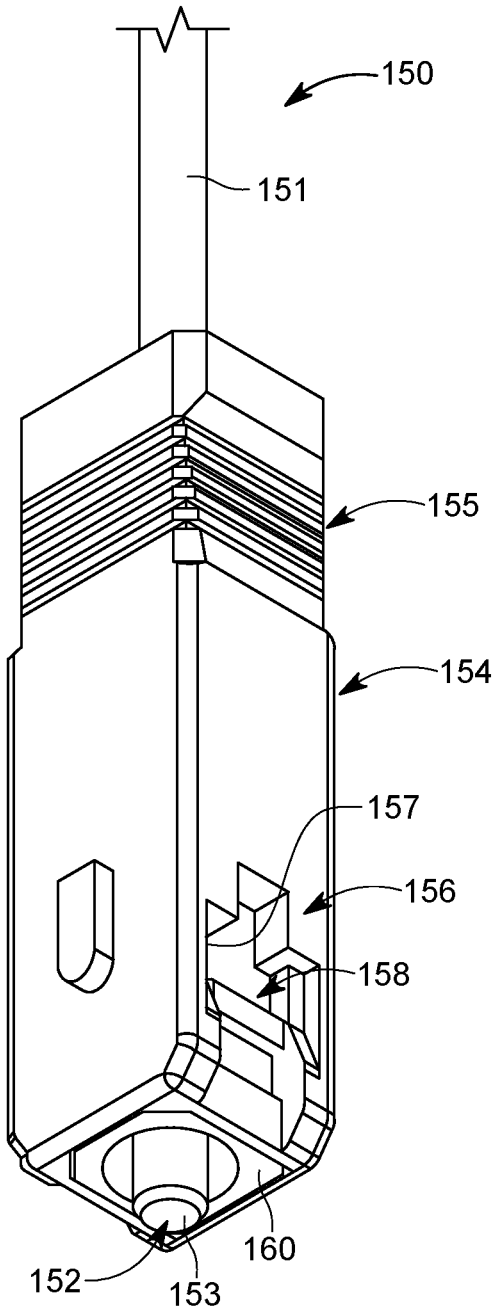
FIG. 2 is a perspective view of a fiber optic connector and cable assembly constructed in accordance with the principles of the present invention.
Figure 3:
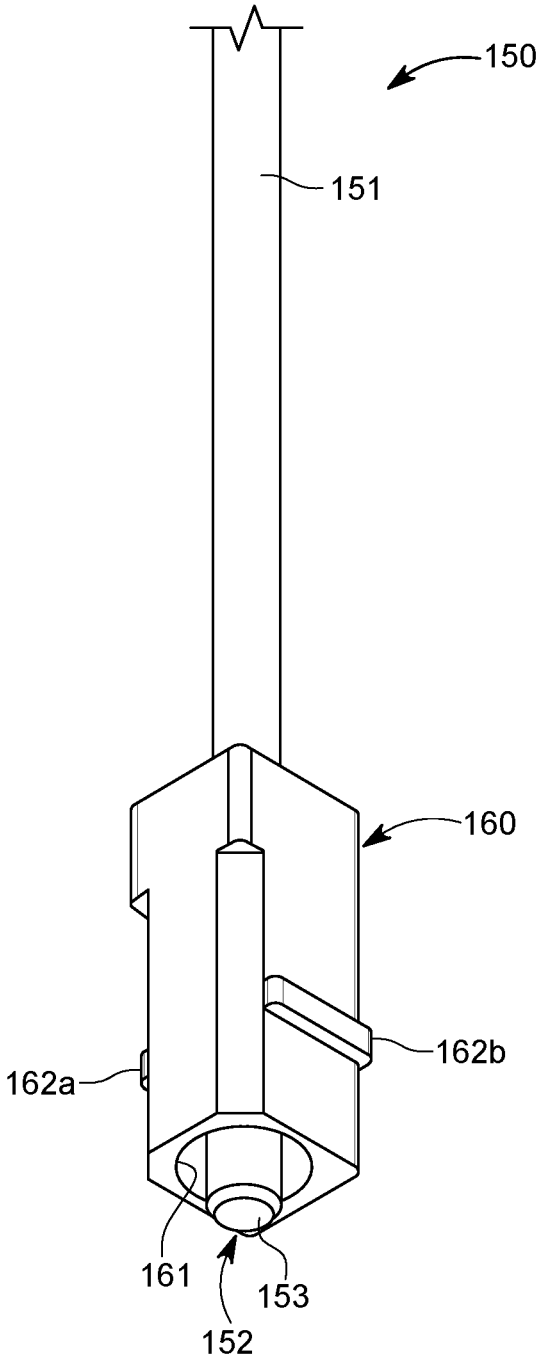
FIG. 3 is a perspective view of the fiber optic connector and cable assembly shown in FIG. 2 without the outer housing assembled.

FIGS. 2 and 3 are perspective views of an example fiber optic SC cable assembly 150, including a fiber cable 151, a ferrule 152, and inner housing 160, and an outer housing 154. The ferrule 152 includes fiber aperture(s) (not shown) to allow the fiber(s) in the fiber cable 151 to go through the ferrule 152 and be polished coplanar to the ferrule end face 153. The inner housing 160, shown in FIG. 3, includes a receiving bore 161 through which the ferrule 152 extends and bars 162*a* and 162*b* on opposing sides of the housing. The bars 162*a* and 162*b* generally include top, side, and bottom surfaces extending outward from the housing a desired distance from the ferrule end face 153. The outer housing 154, shown in FIG. 2, includes a grasping portion 155 proximate its distal end and an engaging portion 156 proximate its proximal end and the ferrule end face 153. The engaging portion 156 includes receiving apertures 157 and latches 158 on opposing sides of the outer housing 154 to receive and engage the bars 162*a* and 162*b* of the inner housing 160. An example of this type of assembly is Part No. 1060655000 from Molex, LLC of Lisle, Ill.

Figure 4:
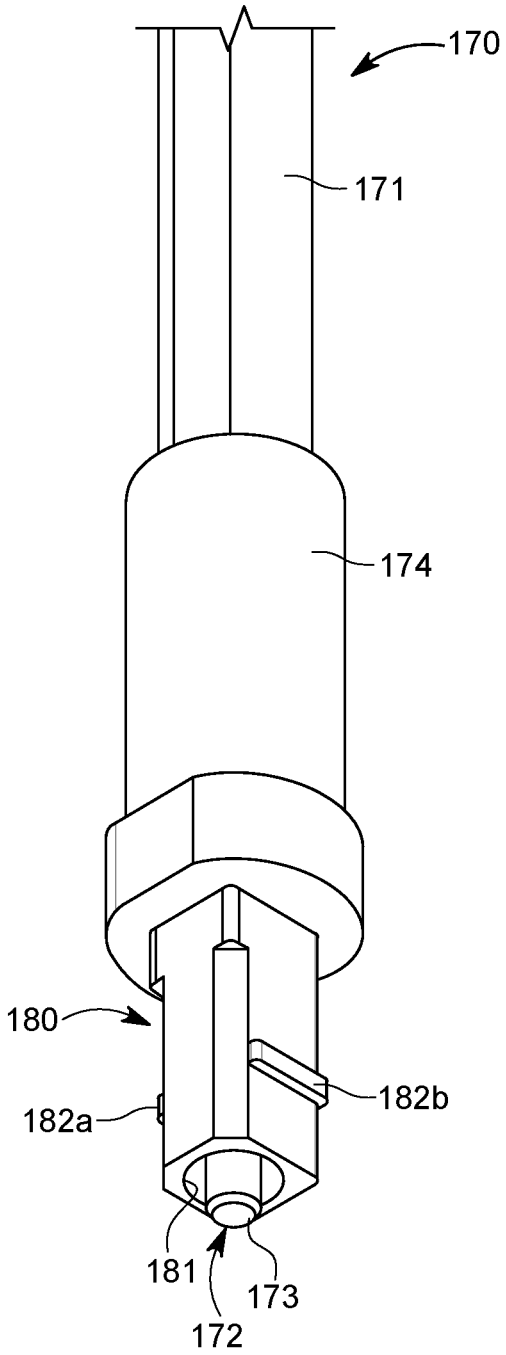
FIG. 4 is a perspective view of another fiber optic connector and cable assembly, without the outer housing assembled, constructed in accordance with the principles of the present invention.

FIG. 4 is a perspective view of another example fiber optic SC cable assembly 170. Fiber optic SC cable assembly 170 includes a fiber cable 171, a ferrule 172, and a housing 180. The ferrule 172 includes a strain relief portion 174 and fiber aperture(s) (not shown) to allow the fiber(s) in the fiber cable 171 to go through the ferrule 172 and be polished coplanar to the ferrule end face 173. The housing 180 includes a receiving bore 181 through which the ferrule 172 extends and bars 182*a* and 182*b* on opposing sides of the housing 180. The bars 182*a* and 182*b* generally include top, side, and bottom surfaces extending outward from the housing 180 a desired distance from the ferrule end face 173. An example of this type of assembly is Part No. 434301EB4FD100E-P from Corning Incorporated of Corning, N.Y.

Although assemblies 150 and 170 are shown and described, and generally known in the art, it is recognized that other suitable types of assemblies could be used. In some embodiments, a fixture could be adapted to receive one or more different types of assemblies.

Embodiments of the present invention provide a fixture and a clamping assembly for connecting a fiber optic SC ferrule assembly to the fixture.

Figure 5:
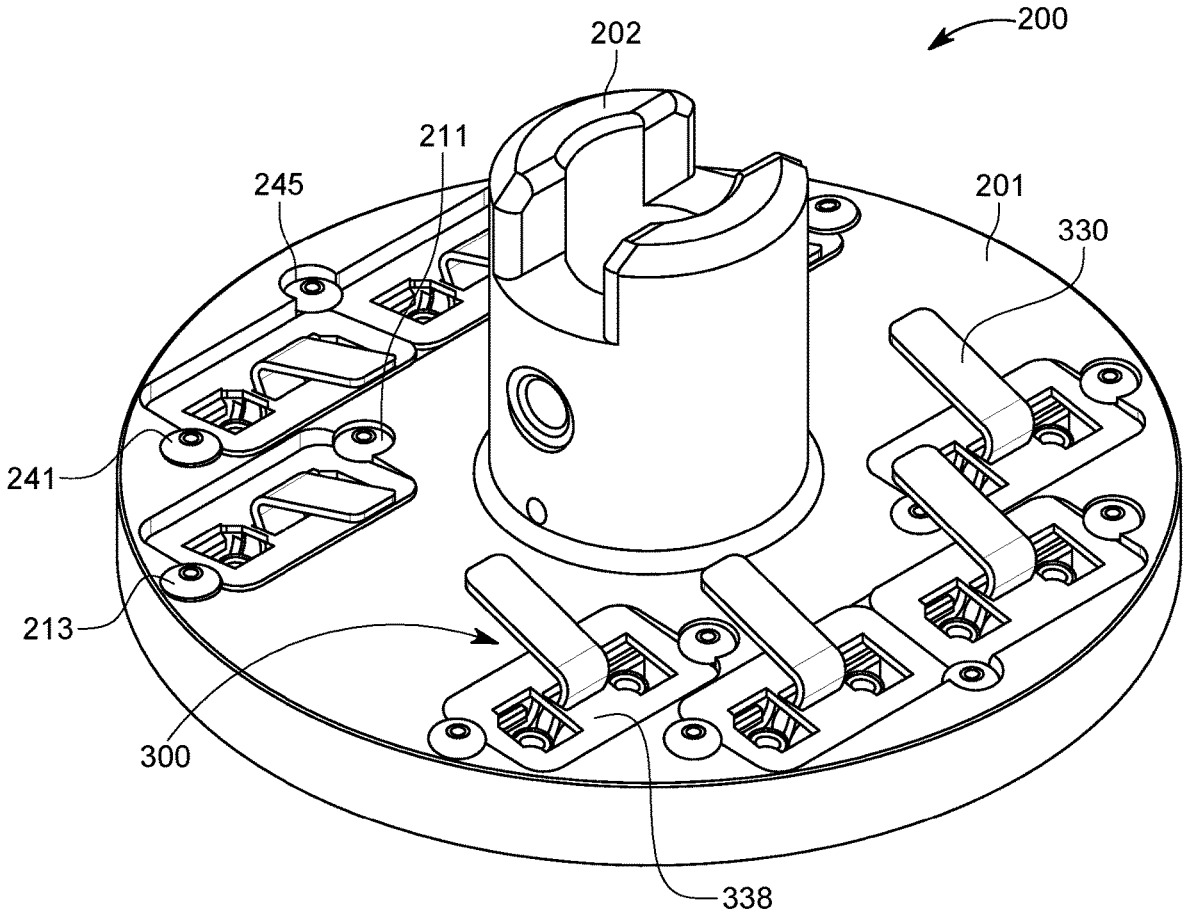
FIG. 5 is a top perspective view of a fixture including a plurality of clamping assemblies constructed in accordance with the principles of the present invention.
Figure 6:
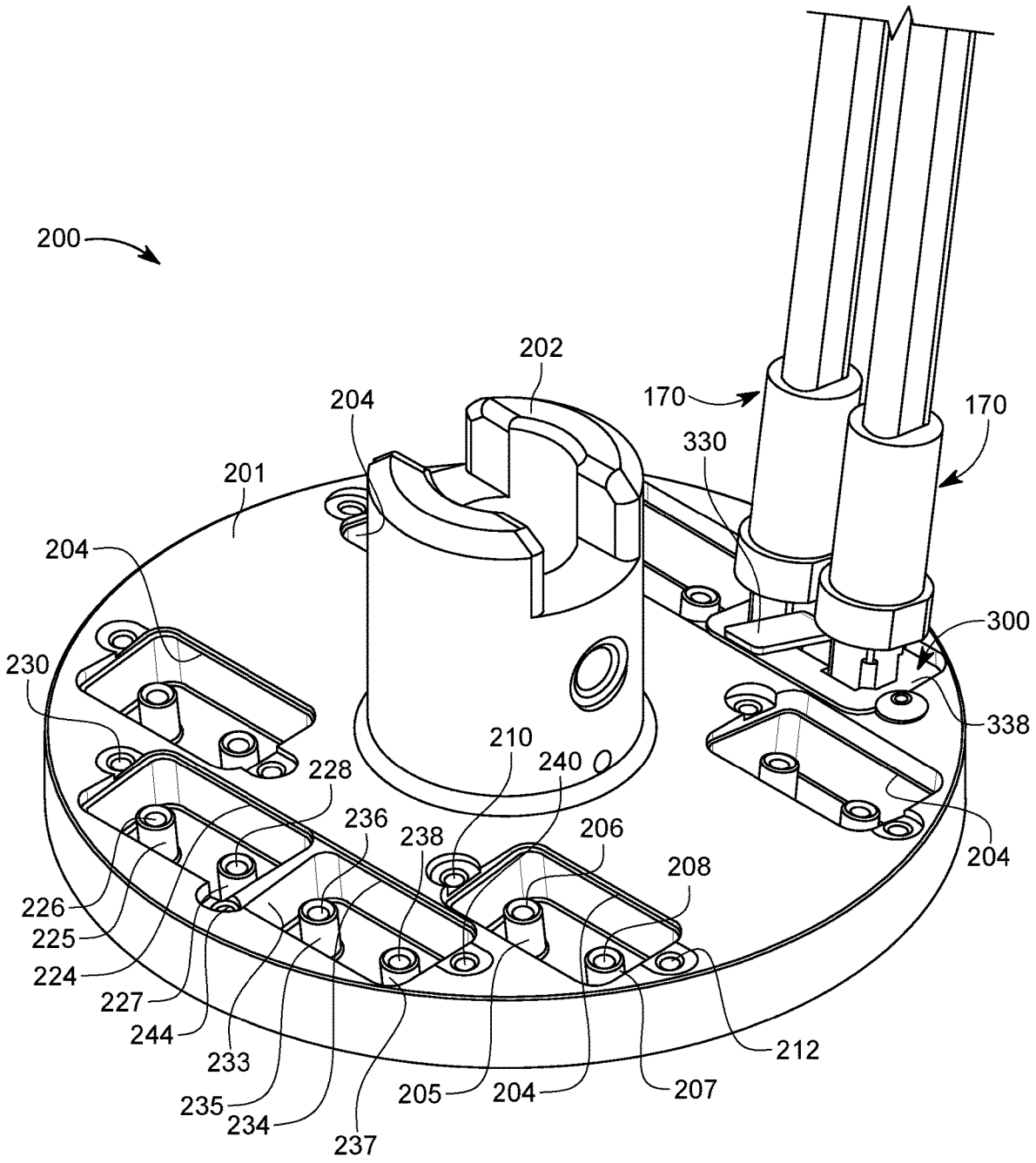
FIG. 6 is a top perspective view of the fixture shown in FIG. 5 with the fiber optic connector and cable assembly shown in FIG. 4 connected to a clamping assembly and the remaining clamping assemblies removed.
Figure 6A:
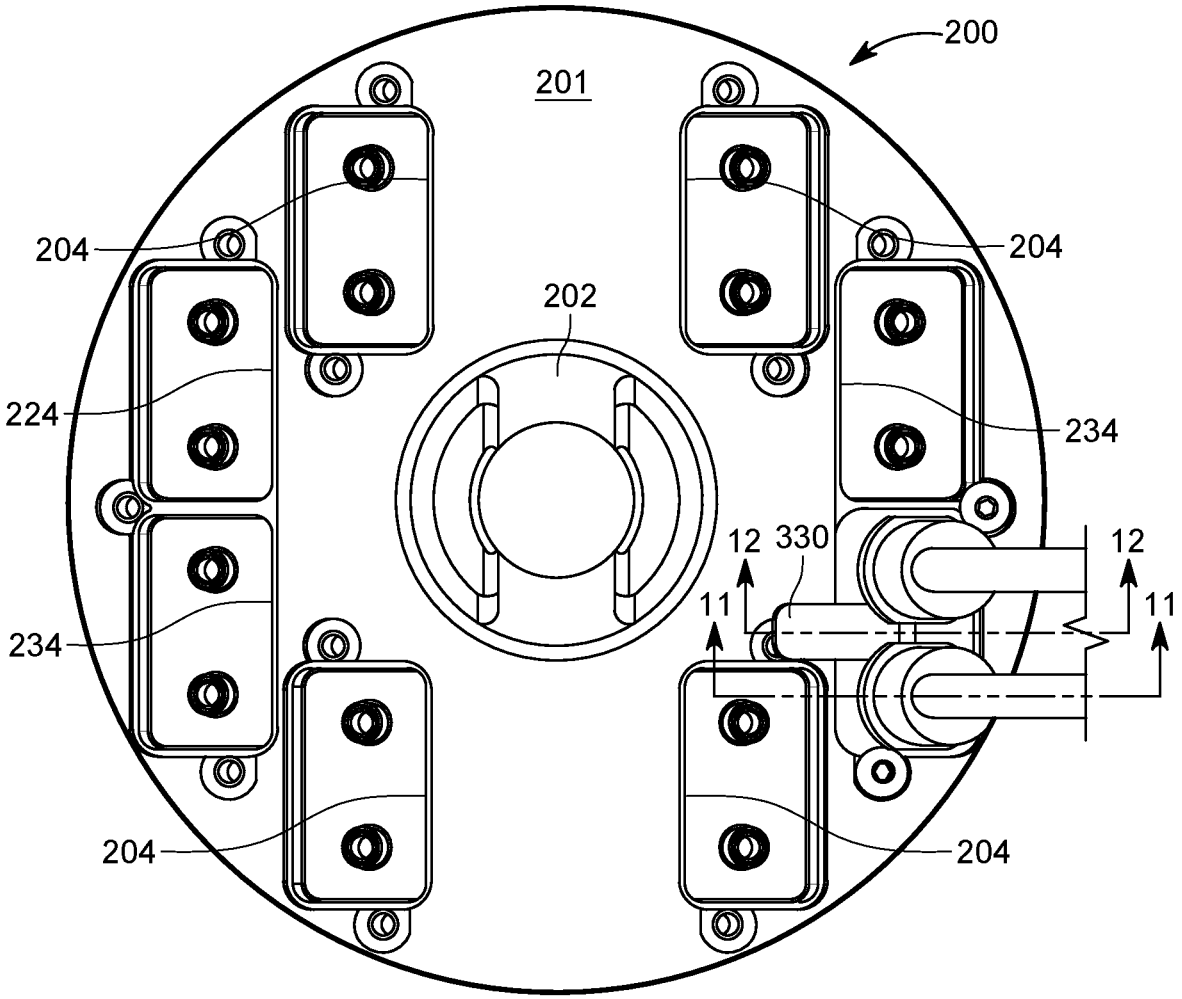
FIG. 6A is a top perspective view of the fixture shown in FIG. 6 with cross section lines 11-11 and 12-12.

In an embodiment shown in FIGS. 5 and 6, fixture 200 includes a generally disk-shaped base 201 having a center portion from which a mounting tube 202 extends upward. The base could be round, rectangular, or other suitable shapes and may not include a mounting tube. The base 201 is configured and arranged to be supported by the platen assembly 108 and the mounting tube 202 is configured and arranged to receive the mounting pole 107. In one embodiment, the base 201 is made of hardened stainless steel and is preferably 0.36 to 0.38 inches thick, however, it is recognized that any suitable thickness could be used as long as it is not too thick so that the ferrule does not sufficiently protrude from the fixture or too thin so that the ferrule does not have adequate support. The thickness of the base could change depending upon the type of ferrule it is holding. The size of the different ferrules may be longer or shorter and the base would change accordingly. Preferably, the ferrule protrudes 0.020 to 0.040 inches out of the bottom of the base referred to as "ferrule protrusion". It is recognized that other suitable materials and dimensions could be used.

As shown in FIG. 6, the base 201 includes different configurations of receiving cavities, and it is recognized that other configurations of receiving cavities could be used. In this example, one receiving cavity 204 is generally a rectangular shaped recessed area including a bottom and sides. First and second supports 205 and 207 with bores 206 and 208, respectively, extend upward from the bottom of the recessed area. The bores 206 and 208 are configured and arranged to receive the ferrules so that they extend therethrough and protrude out of the bottom of the base 201, and the housings rest on top of the supports. In this example, the supports are generally positioned between the ferrules and the housing. On opposing sides of the cavity 204, the base 201 includes recessed bores 210 and 212, which are preferably threaded, configured and arranged to receive fasteners 211 and 213, which are preferably screws.

Another receiving cavity includes first and second receiving cavities 224 and 234, with a divider 233 between them. First receiving cavity 224 is generally a rectangular shaped recessed area including a bottom and sides, one side being formed by divider 233. First and second supports 225 and 227 with bores 226 and 228, respectively, extend upward from the bottom of the recessed area. The bores 226 and 228 are configured and arranged to receive the ferrules. On a side opposing divider 233, the base 201 includes recessed bore 230, which is preferably threaded, configured and arranged to receive fastener 231, which is preferably a screw.

Second receiving cavity 234 is generally a rectangular shaped recessed area including a bottom and sides, one side being formed by divider 233. First and second supports 235 and 237 with bores 236 and 238, respectively, extend upward from the bottom of the recessed area. The bores 236 and 238 are configured and arranged to receive the ferrules. On a side opposing divider 233, the base 201 includes recessed bore 240, which is preferably threaded, configured and arranged to receive fastener 241, which is preferably a screw.

First and second receiving cavities 224 and 234 are adjacent, and proximate their juncture is an intermediate recessed bore 244, which is preferably threaded, configured and arranged to receive fastener 245, which is preferably a screw.

In this example, receiving cavities 224 and 234 are positioned proximate the outer circumference on opposing sides of the base 201, and the receiving cavities 204 are positioned between the receiving cavities 224 and 234 and the mounting tube 202, proximate the outer circumference.

Figure 7:
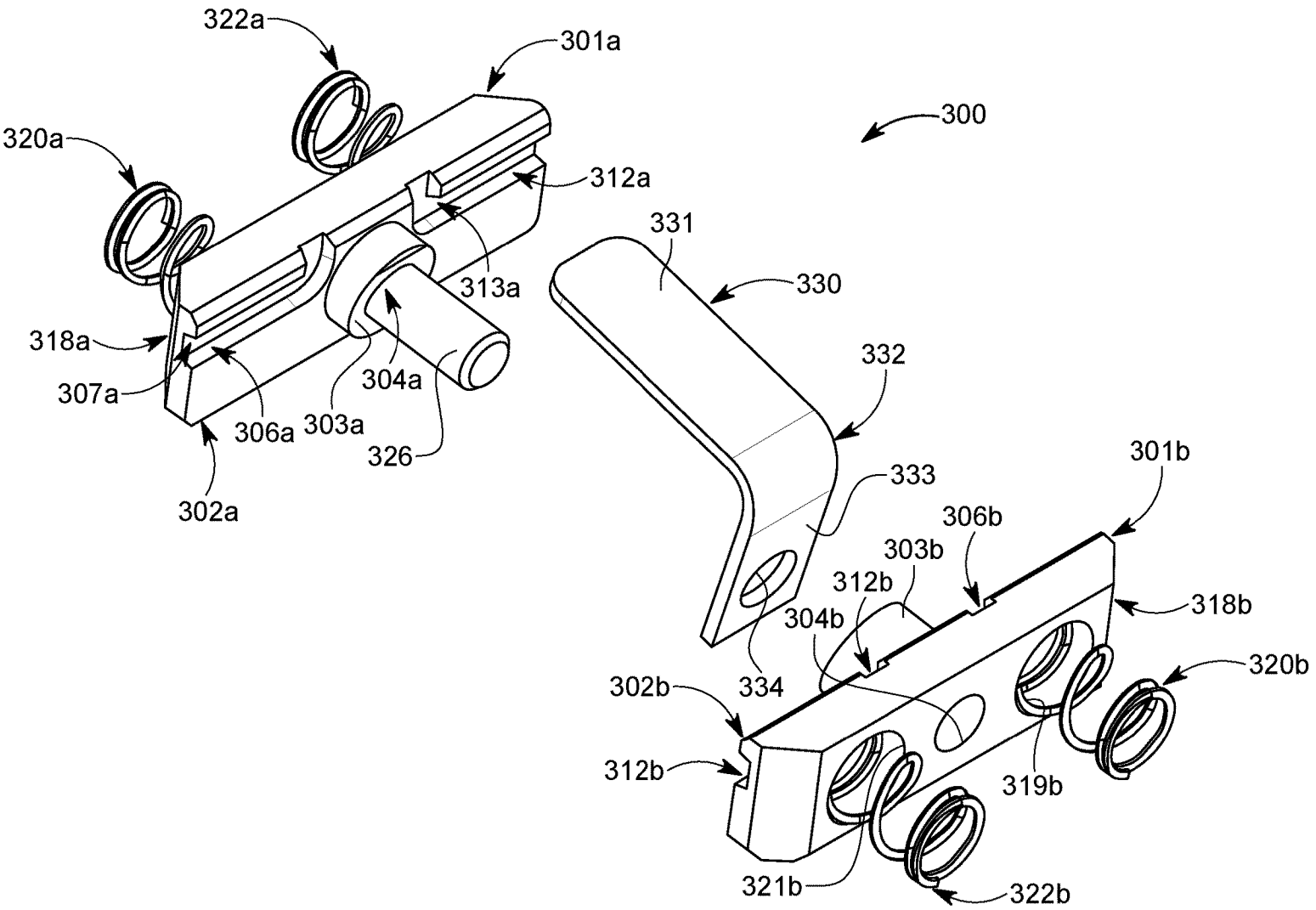
FIG. 7 is an exploded perspective view of a clamping assembly of the fixture shown in FIG. 5.

The clamping assembly 300 is shown in FIG. 7. The clamping assembly 300 generally includes a base with a first base portion 301*a* and a second base portion 301*b*, a lever 330, a pin 326, and a biasing member.

The first and second base portions 301*a* and 301*b* are generally similar except for angles of their inner facing angled surfaces 305*a* and 305*b*. Therefore, base portions 301*a* and 301*b* include similar components, which have corresponding reference numerals.

Figure 8:
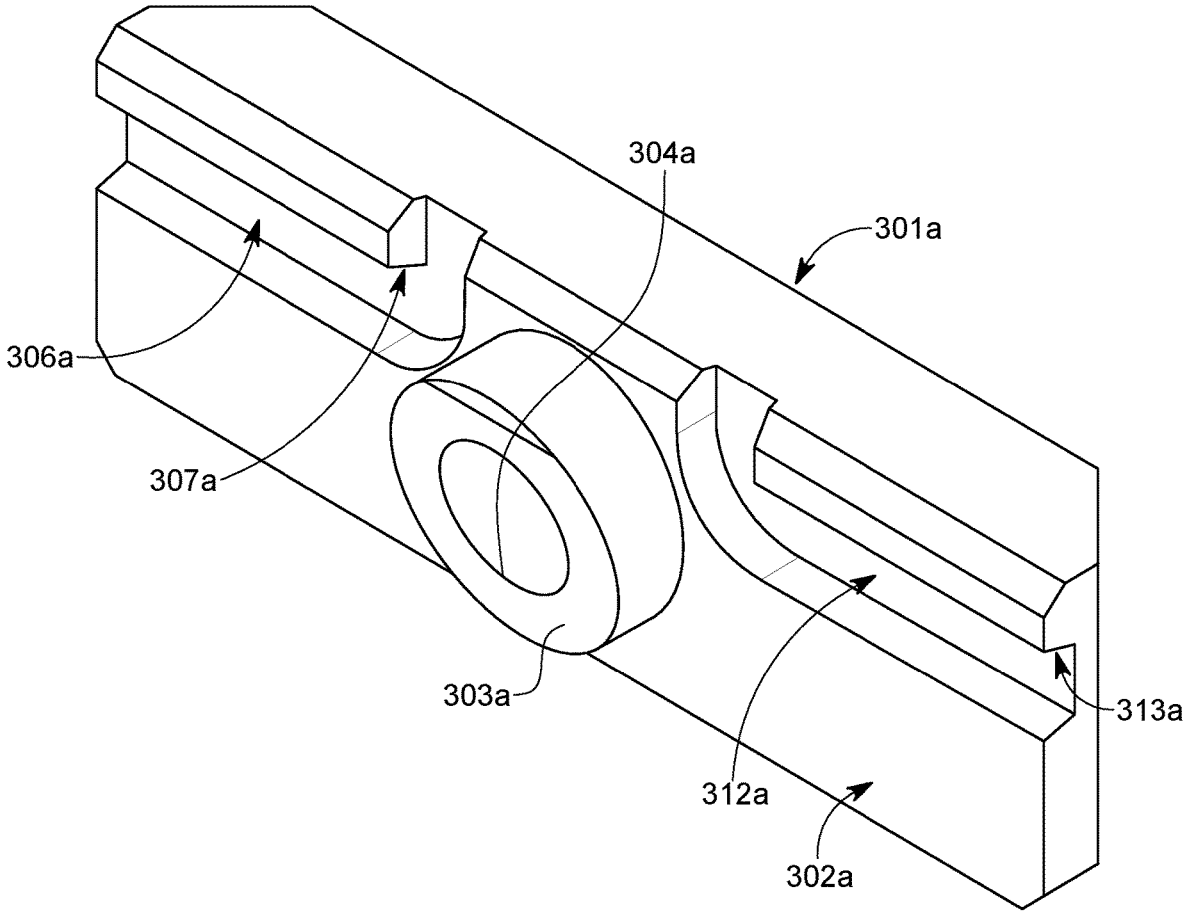
FIG. 8 is a perspective view of a base portion of the clamping assembly shown in FIG. 7.
Figure 13:
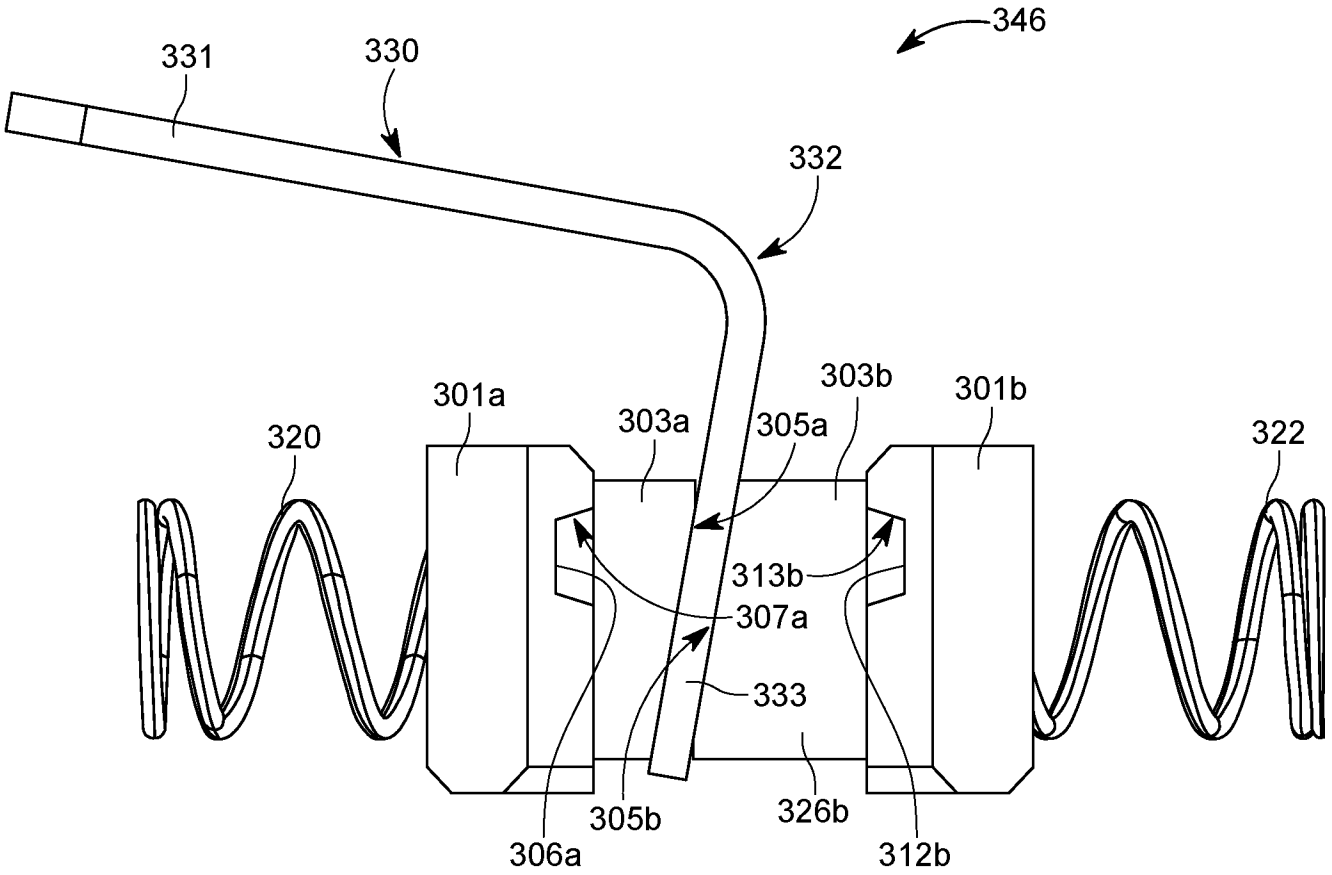
FIG. 13 is a side view of the clamping assembly shown in FIG. 7 in a locked position.
Figure 16:
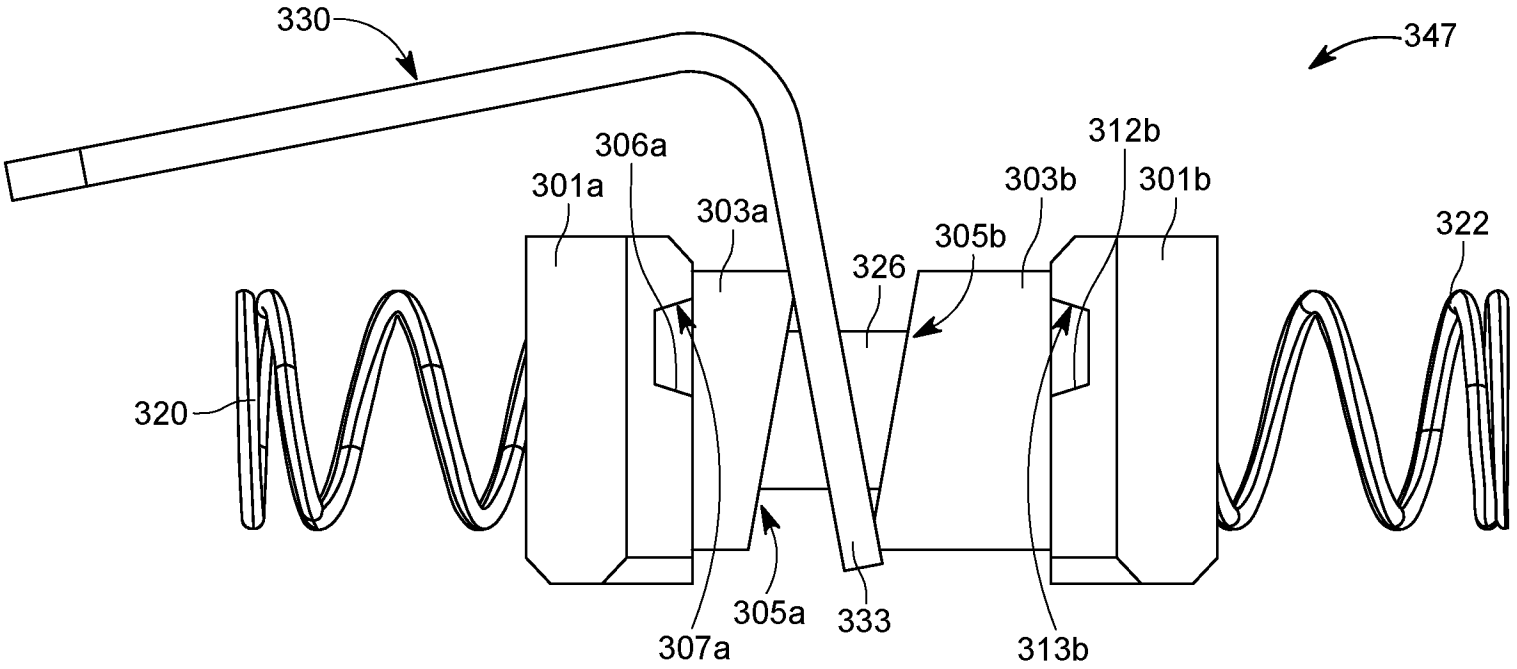
FIG. 16 is a side view of the clamping assembly shown in FIG. 7 in an unlocked position.

The first base portion 301*a*, shown in FIG. 8, includes an inner facing side 302*a* and an outer facing side 318*a*. A receiver 303*a* is generally positioned in the middle of the first base portion 301*a* and extends outward from the inner facing side 302*a*. The receiver 303*a* is generally cylindrical and includes a bore 304*a* and an inner facing angled surface 305*a*. The bore 304*a* is configured and arranged to slidably receive a pin 326. The inner facing angled surface 305*a* is angled so that the top is longer than the bottom of the receiver 303*a*. This is illustrated in FIGS. 13 and 16. The inner facing side 302*a* also includes slots 306*a* and 312*a* on opposing sides of the receiver 303*a*. The slots 306*a* and 312*a* extend from proximate the middle of the respective end toward the receiver 303*a* and then upward to the top proximate the receiver 303*a*. The slots 306*a* and 312*a* form receiving portions for the bars of the fiber optic connector and cable assemblies. In this example, the slots are formed by three surfaces, an upper surface, a lower surface, and a connecting surface. The upper surfaces of the slots 306*a* and 312*a* are preferably tapered downward so that the openings of the slots are wider than the insides of the slots proximate the connecting surface.

The outer facing side 318*a* includes a receiver bore (not shown) on each side of the bore 304*a* in which an end of a biasing member is positioned. Although coils springs 320*a* and 322*a* are shown as the biasing members, it is recognized that leaf springs or other suitable biasing members could be used.

The second base portion 301*b* includes an inner facing side 302*b* and an outer facing side 318*b*. A receiver 303*b* is generally positioned in the middle of the first base portion 301*b* and extends outward from the inner facing side 302*b*. The receiver 303*b* is generally cylindrical and includes a bore 304*b* and an inner facing angled surface 305*b*. The bore 304*b* is configured and arranged to slidably receive pin 326. Alternatively, one of the bores 304*a* or 304*b* may be sized to provide a friction fit with the pin 326. The inner facing angled surface 305*b* is angled so that the top is shorter than the bottom of the receiver 303*b*, which is different than the inner facing angled surface 305*a*. This is illustrated in FIGS. 13 and 16. The inner facing side 302*b* also includes slots 306*b* and 312*b* on opposing sides of the receiver 303*b*. The slots 306*b* and 312*b* extend from proximate the middle of the respective end toward the receiver 303*b* and then upward to the top proximate the receiver 303*b*. The slots 306*b* and 312*b* form receiving portions for the bars of the fiber optic connector and cable assemblies. The upper surfaces of the slots 306*b* and 312*b* are preferably tapered downward so that the openings of the slots are wider than the insides of the slots.

The outer facing side 318*b* includes a receiver bore 319*b* and 321*b* on each side of the bore 304*b* in which an end of a biasing member is positioned. Although coils springs 320*b* and 322*b* are shown as the biasing members, it is recognized that leaf springs or other suitable biasing members could be used. A single biasing member could also be used to bias both of the first and second base portions 301*a* and 301*b*.

Figure 9:
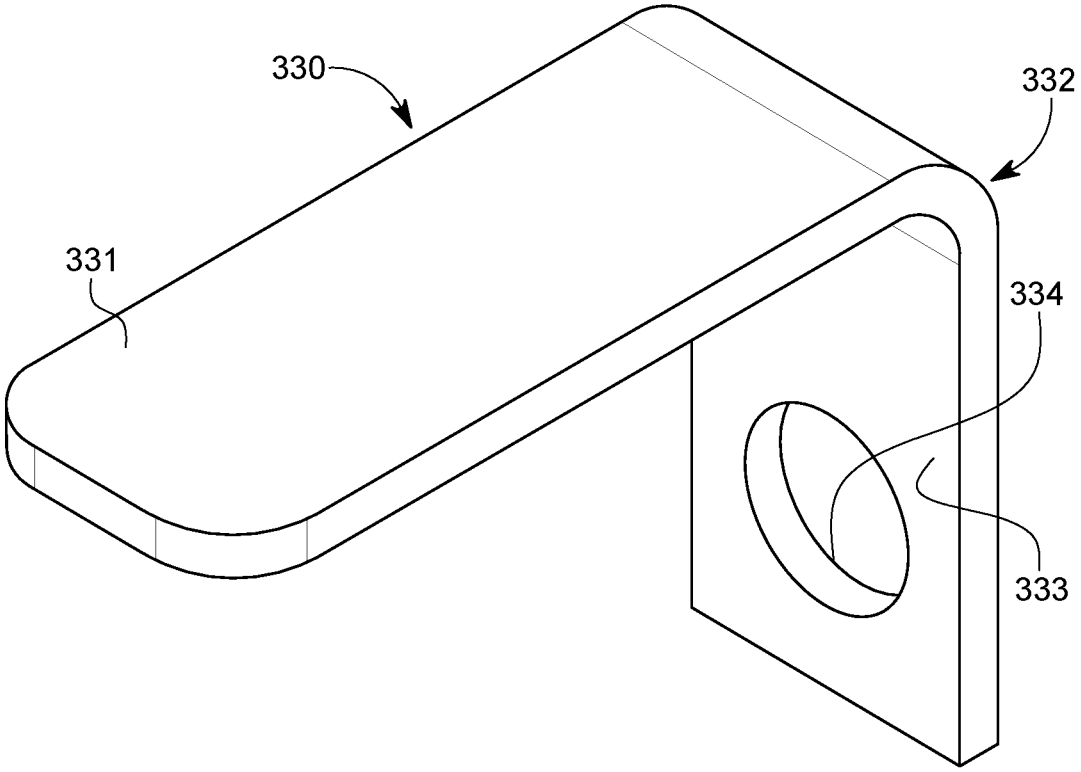
FIG. 9 is a perspective view of a lever of the clamping assembly shown in FIG. 7.

The lever 330, shown in FIG. 9, is generally L-shaped but could be any configuration from straight to having multiple bends with any size radii so long as it is able to actuate the clamping mechanism without interfering with the connectors being loaded into the clamping mechanism. The lever 330 includes a first end 331, a bent portion 332, and a second end 333. The second end 333 includes an aperture 334 configured and arranged to slidably receive the pin 326.

To assemble the clamping assembly 300, the pin 326 is positioned in one of the bores 304*a* or 304*b*, through the aperture 334 of the lever 330, and into the other of the bores 304*a* or 304*b*, and the ends of the springs 320*a*, 322*a*, 320*b* and 322*b* are positioned in the respective receiver bores 319*a*, 321*a*, 319*b*, and 321*b*. Optionally, one of the bores of the base portions could be sized to provide a friction fit with the pin 326 so that the pin 326 only slid through the other bore. This is one example of assembly as it is recognized that the clamping assembly 300 could be assembled in any suitable order or manner.

The assembled clamping assembly is inserted into the desired receiving cavity (e.g., receiving cavities 204, 224, and 234), with the first and second base portions 301*a* and 301*b* extending generally lengthwise along opposite sides of the cavity. To insert the clamping assembly, the springs of the first and second base portions 301*a* and 301*b* are compressed and then slid into the receiving cavity. The springs contact the sides of the base forming the receiving cavity and exert force on the first and second base portions 301*a* and 301*b*, biasing them toward each other. To secure the clamping assembly, a connecting plate 338 is used.

Figure 10:
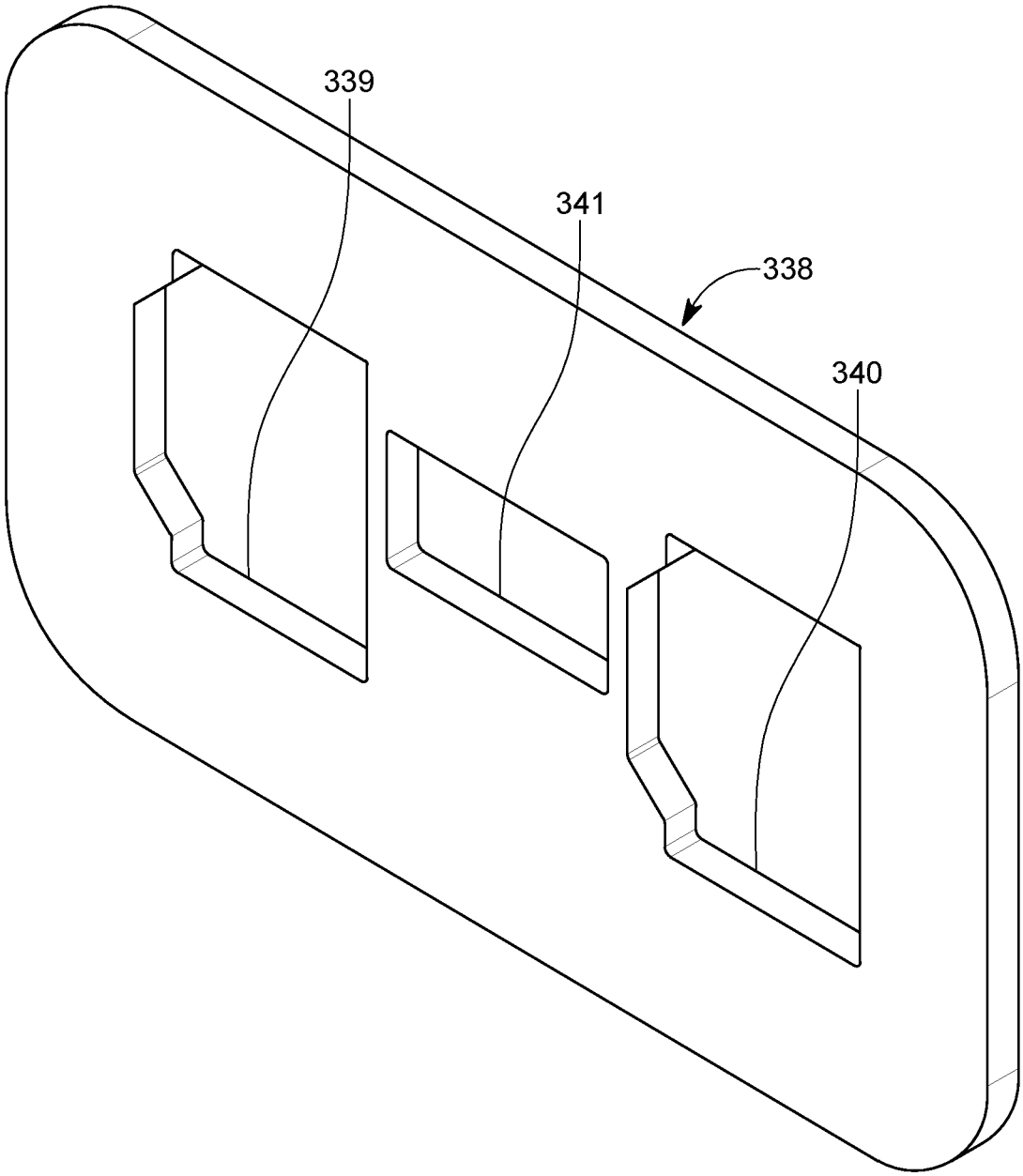
FIG. 10 is a perspective view of a connecting plate for connecting the clamping assembly shown in FIG. 7 to the fixture shown in FIG. 5.

The connecting plate 338, shown in FIG. 10, is generally rectangular-shaped with a lever aperture 341 between first and second connector apertures 339 and 340. The first and second connector apertures 339 and 340 may be configured and arranged to receive a portion of the housing 180 surrounding the ferrule 172 in a desired orientation to ensure proper loading of the fiber optic cable assembly 170. For example, the apertures 339 and 340 may include cut-off corners corresponding with those of the housing 180. After the assembled clamping assembly 300 is positioned in one of the receiving cavities of the base 201, the lever 330 is inserted through the lever aperture 341 of the connecting plate 338, and the connecting plate 338 is positioned on top of the clamping assembly. Fasteners (e.g., fasteners 211 and 213 for receiving cavity 204, and fasteners 241 and 245 for receiving cavity 234) are inserted into the bores to secure the connecting plate 338, and therefore the clamping assembly, to the base 201.

Although this example includes two fiber optic SC cable assembly connections for each base cavity/clamping assembly, it is recognized that at least one connection could be used. As a non-limiting example, two connections could be positioned on each side of the lever.

Figure 11:
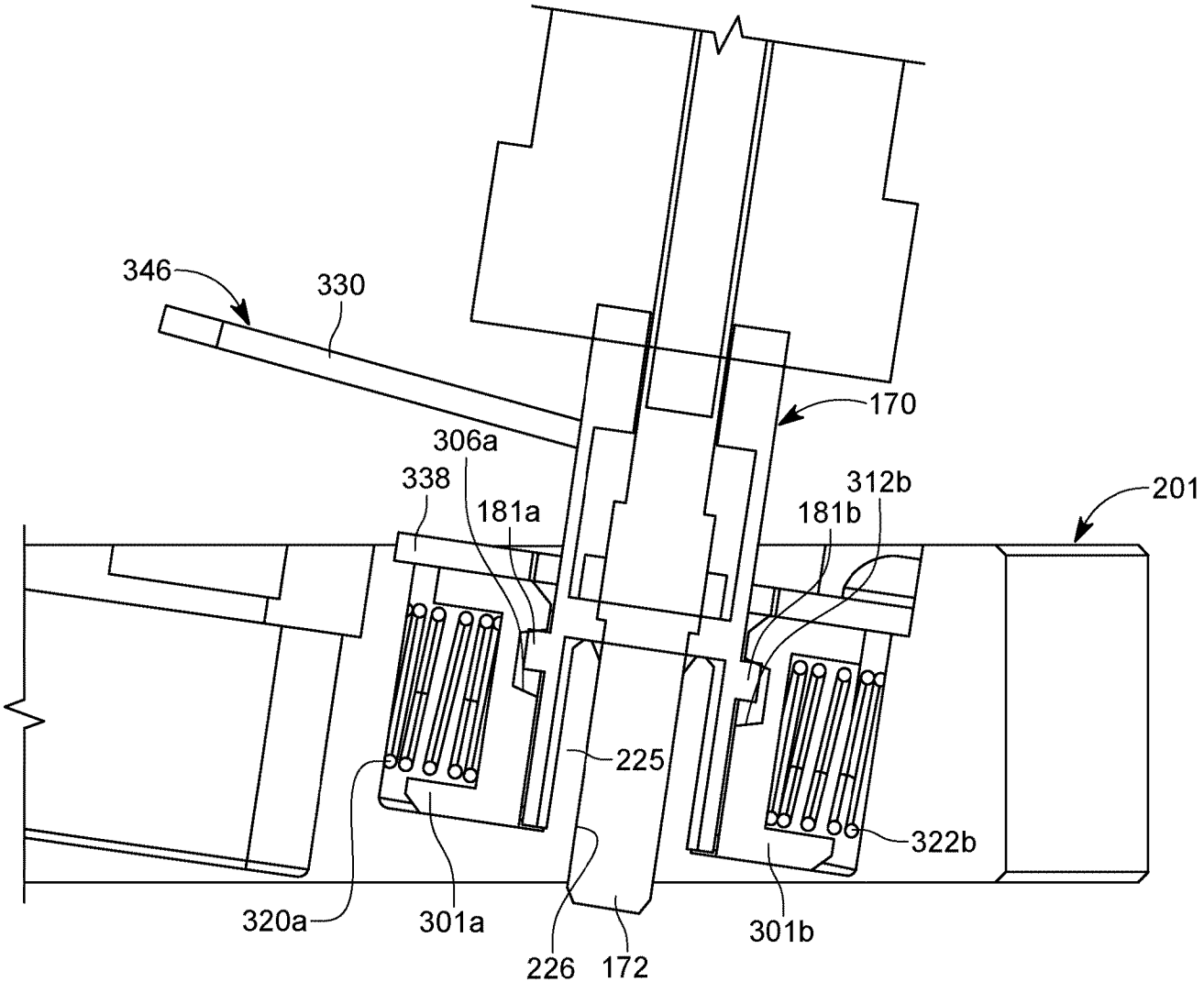
FIG. 11 is a cross section view of a portion of the fixture shown in FIG. 6A taken along the lines 11-11 in FIG. 6A in a locked position engaging a fiber optic connector and cable assembly shown in FIG. 4.
Figure 12:
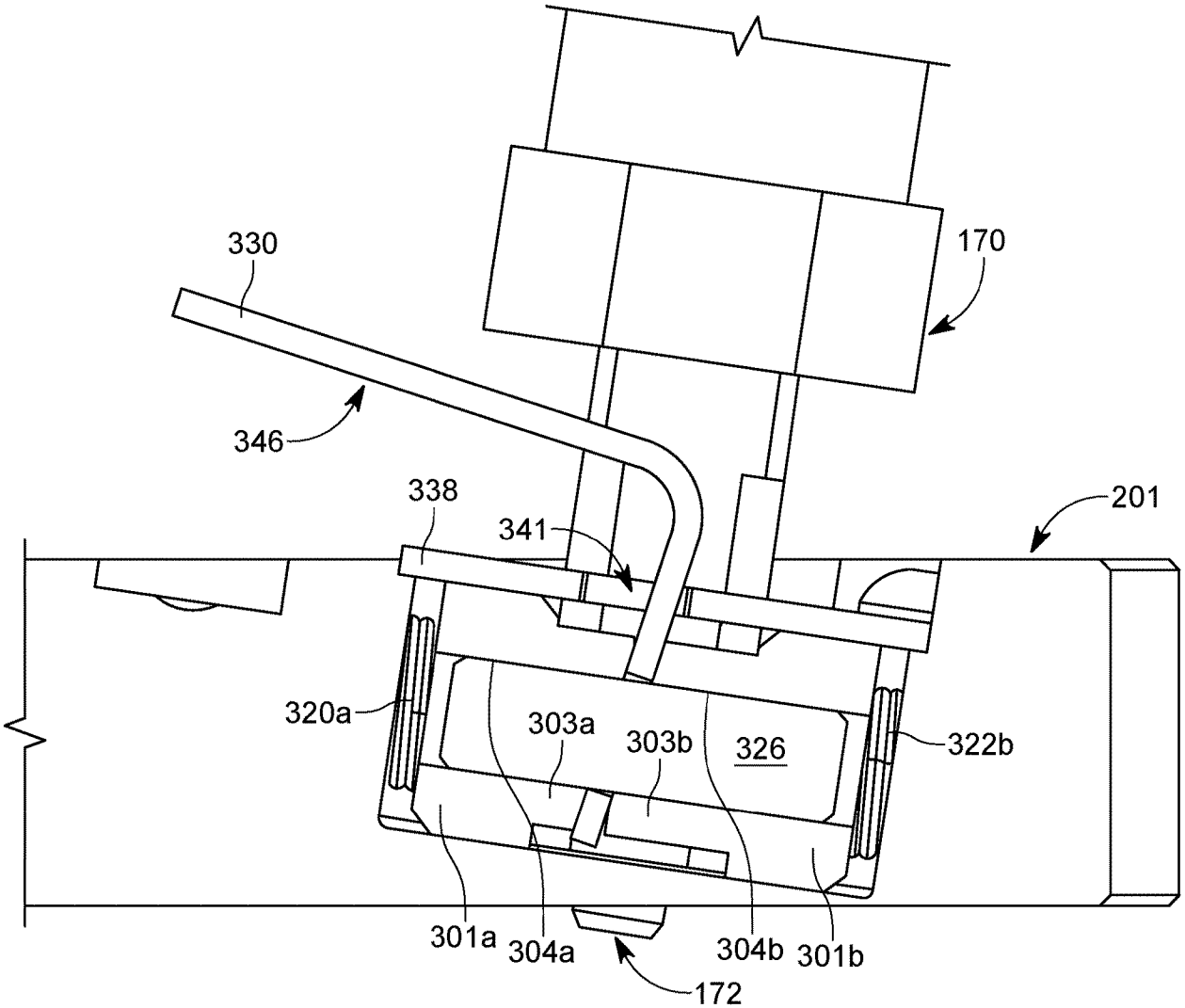
FIG. 12 is a cross section view of a portion of the fixture shown in FIG. 6A taken along the lines 12-12 in FIG. 6A in a locked position engaging a fiber optic connector and cable assembly shown in FIG. 4.
Figure 14:
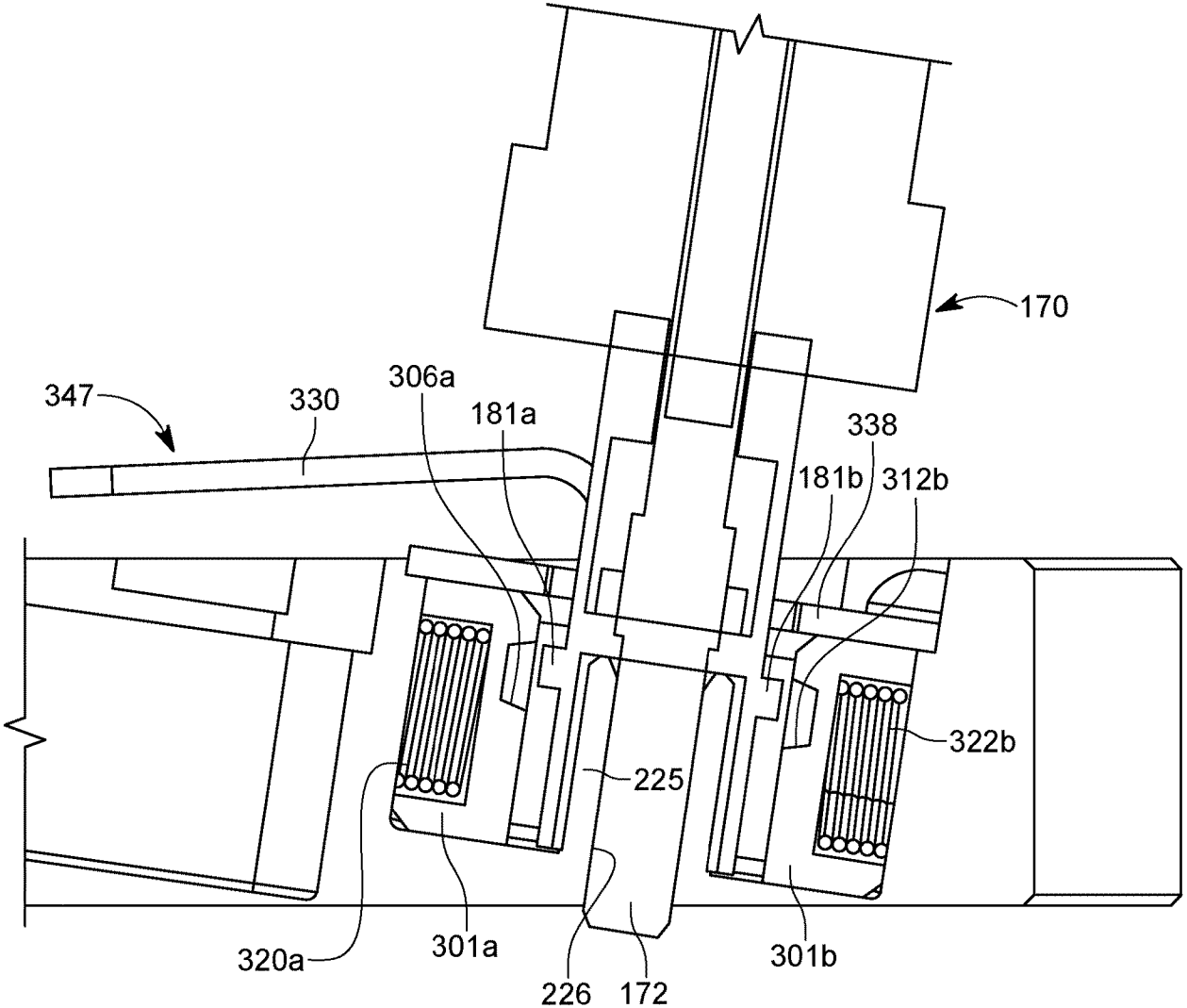
FIG. 14 is a cross section view of a portion of the fixture shown in FIG. 6A similar to FIG. 11 but in an unlocked position disengaging the fiber optic connector and cable assembly shown in FIG. 4.
Figure 15:
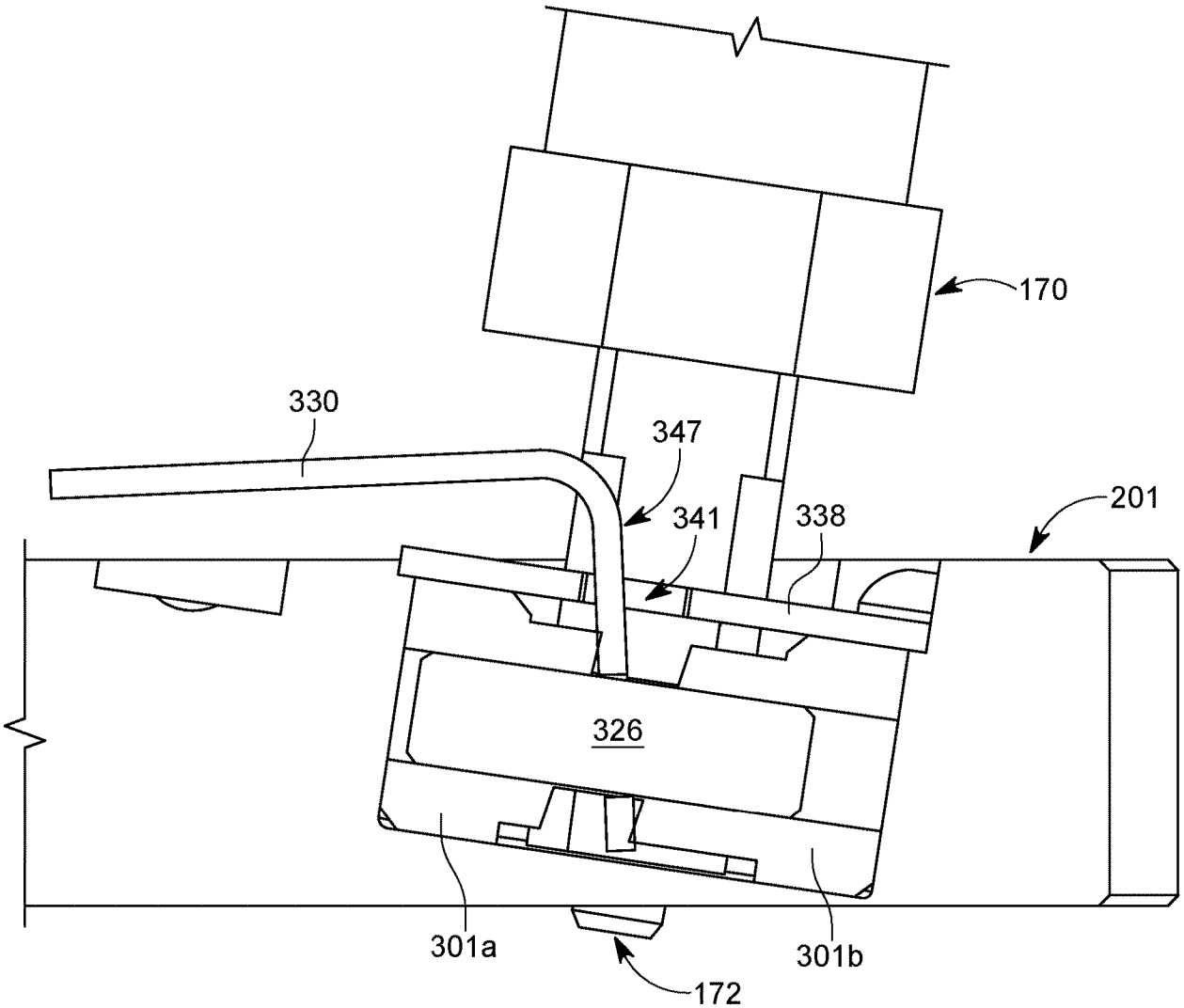
FIG. 15 is a cross section view of a portion of the fixture shown in FIG. 6A similar to FIG. 12 but in an unlocked position disengaging the fiber optic connector and cable assembly shown in FIG. 4.

In operation, the clamping assembly 300 is biased toward the locked position 346, shown in FIGS. 11-13. To either insert or remove a ferrule into or from a support in a receiving cavity, the lever 330 is pushed downward, pushing against the inner facing angled surfaces 305*a* and 305*b* to overcome the biasing forces of the springs, and moving the first and second base portions 301*a* and 301*b* apart into an unlocked position 347. The unlocked position 347 is shown in FIGS. 14-16. The first inner facing angled surface 305*a* has a first angle and the second inner facing angled surface 305*b* has a second angle, and the first and second angles are configured and arranged to allow a majority of the first and second inner facing surfaces 305*a* and 305*b* to contact the lever 330 in the locked position 346 and a minority of the first and second inner facing surfaces 305*a* and 305*b* to contact the lever 330 in the unlocked position 347. When the downward force is removed from the lever, the biasing members will push the first and second base portions 301*a* and 301*b* toward one another thereby moving from the unlocked position 347 toward the locked position 346. Depending upon the size of the ferrule, there could be space between the lever 330 and at least one of the inner facing angles surfaces 305*a* and 305*b* in the locked position 346. The locked position 346 is a position in which the bars are positioned within the slots and there is little to no movement of the ferrule within the clamping assembly and relative to the base 201.

When a ferrule is positioned in the connector in the receiving cavity and the springs are biasing the first and second base portions 301*a* and 301*b* toward the ferrule, the bars are positioned in the slots. The upper portions forming the slots could be relative straight with minimal clearance for the bars or they could be tapered, acting like ramps to guide the ferrule downward as the base portions move toward each other. The tapering of the slots 306*a*, 312*a*, 306*b*, and 312*b* assists in providing a tighter, more secure fit of the bars, and therefore the fiber optic connector and cable assemblies, within the clamping assemblies because the fiber optic connector and cable assemblies move downward as the bars move along the tapered surfaces as the first and second base portions 301*a* and 301*b* move toward each other.

The above specification, examples, and data provide a complete description of the manufacture and use of the composition of embodiments of the invention. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the invention. Therefore, it is manifestly intended that this invention be limited only by the claims and the equivalents thereof.

The invention claimed is:

1. A method of connecting a ferrule to an optical fiber polishing fixture assembly, comprising:

obtaining a fixture base to which a clamping assembly is operatively connected, the fixture base having a receiving cavity in which a ferrule support having a ferrule bore is positioned, the clamping assembly having first and second base portions, a lever, and a biasing member, the first base portion having a first inner facing side with a first inner facing surface, the second base portion having a second inner facing side with a second inner facing surface, the lever having a first end positioned between the first and second inner facing surfaces and a second end extending outward therefrom, and the biasing member biasing the first and second base portions toward each other, the first and second base portions, the first end of the lever, and the biasing member being configured and arranged to be received in the receiving cavity and operatively connected to the fixture base, the clamping assembly having a locked position and an unlocked position, the locked position being when the first and second base portions are biased toward one another, the unlocked position being when the lever overcomes a biasing force of the biasing member and separates the first and second base portions, wherein as the lever is moved from the locked position to the unlocked position, the lever overcomes the biasing force and moves the first and second base portions away from one another;

positioning the lever in the unlocked position thereby creating a gap between the first and second base portions;

obtaining a fiber optic connector and cable assembly including a ferrule operatively connected to a cable;

positioning the ferrule in the ferrule bore; and moving the lever from the unlocked position to the locked position thereby causing the first and second base portions to engage the fiber optic connector and cable assembly.

2. The method of claim 1, wherein the first base portion includes a first slot in the first inner facing side, the second base portion includes a second slot in the second inner facing side, and the fiber optic connector and cable assembly includes bars on opposing sides, the method further comprising positioning the bars in the first and second slots in the locked position.

* * * * *